US005598095A

United States Patent [19]

Schnaitter

[11] Patent Number: 5,598,095

[45] Date of Patent: Jan. 28, 1997

[54] SWITCHABLE CURRENT SOURCE FOR DIGITAL-TO-ANALOG CONVERTER (DAC)

[75] Inventor: William N. Schnaitter, San Ramon, Calif.

[73] Assignee: Alliance Semiconductor Corporation, San Jose, Calif.

[21] Appl. No.: 401,022

[22] Filed: Mar. 8, 1995

[51] Int. Cl.[6] ..... G05F 3/16

[52] U.S. Cl. ..... 323/315; 323/317

[58] Field of Search ..... 323/312, 315, 323/317; 327/530, 538; 341/144

[56] References Cited

U.S. PATENT DOCUMENTS

| | | | |
|---|---|---|---|
| 3,936,725 | 2/1976 | Schneider | 323/315 |
| 4,016,435 | 4/1977 | Voorman | 307/296 R |
| 4,229,729 | 10/1980 | Devendorf et al. | 340/347 AD |
| 4,408,190 | 10/1983 | Nagano | 340/347 DA |
| 4,573,005 | 2/1986 | Van De Plassche | 323/315 |
| 4,904,922 | 2/1990 | Colles | 323/316 |
| 4,967,140 | 10/1990 | Groeneveld et al. | 323/315 |
| 5,166,540 | 11/1992 | Park | 307/227 |
| 5,272,432 | 12/1993 | Nguyen et al. | 323/315 |
| 5,285,148 | 2/1994 | Uhlenhoff et al. | 323/272 |
| 5,430,400 | 7/1995 | Herlein et al. | 327/108 |

*Primary Examiner*—Peter S. Wong
*Assistant Examiner*—Adolf Berhane
*Attorney, Agent, or Firm*—Bradley T. Sako

[57] ABSTRACT

A switchable current source (10) for video DACs that reduces output transients. The switchable current source (10) includes a current mirror (20) connected to a cascode pair (22) for providing a reference current input and a current output. Connected to the reference current input is reference current generator (14) that includes p-channel transistor Q5 for providing a reference current according to the voltage applied at its gate by voltage source (24). A current switch (16) is connected to the current output and includes p-channel transistor Q6 for providing a path to ground and p-channel transistor Q7 for providing a path to an output node. In response to a decoder input DEC, an enable signal generator (18) outputs an enable signal EN and an inverted enable signal ENI to Q7 and Q6, respectively. The enable signal generator (18) includes a delay path (30 and 34) for both the EN and ENI signals so that during a low-to-high transition of signal DEC, EN is delayed so that ENI turns Q7 on before EN shuts off Q6. During a high-to-low transition of DEC, ENI is delayed so that Q6 is turned on before Q7 is turned off.

20 Claims, 3 Drawing Sheets

SWITCHABLE CURRENT SOURCE FOR DIGITAL-TO-ANALOG CONVERTER (DAC)

TECHNICAL FIELD

The present invention relates generally to switchable current sources, and more specifically to switchable current sources for current scaling video digital-to-analog converters (DACs).

BACKGROUND OF THE INVENTION

While electronic signals continue to be sampled, stored, manipulated and transmitted in digital form, certain applications and hardware still require an analog signal as an input. This is particularly true for computer monitors. The typical VGA computer monitor still requires a color VGA analog input to drive the display. Presently, this analog signal is provided by video color pallet digital-to-analog converter (DAC).

The general family of DACs includes both voltage scaling, charge scaling and current scaling designs. In each of these types of DACs, a number of binary weighted circuits are selectively summed at a common node according to a digital input. Due to changes in node voltages, voltage scaling DACs produce switching transients that can result in conversion errors unless an appropriate settling time is taken into consideration.

Current scaling DACs contain a number of switchable current sources that selectively switch an output current into a current summing node in response to a digital input signal. Each switchable current source can be conceptualized as having a current source, and a current switch. The current source functions to provides a binary weighted output current. In the prior art it is known to use current mirrors as current sources. Improved current mirrors are set forth in U.S. Pat. No. 3,936,725 issued to Herbert A. Schneider on Feb. 3, 1976. The current switch, positioned between the current source and the summing node, switches the output current into the summing node according to the digital input. The summation of binary weighted output currents from the various switchable current sources provides an analog of the digital input received by the DAC. For accuracy in the digital-to-analog conversion it is essential that each switchable current source, when switched on, provide a reliable, precise output current to the summing node. Accordingly, it would be desirable to have a switchable current source with a current magnitude determining circuit that is isolated from the current switch.

Current scaling DACs also have an additional drawback in the form of output transients that can appear on the summing output node, often called glitches. Glitches originate during the conversion process as some current sources are switched on (and into the output node) while others are switched off. Some of the factors believed to give rise to glitches are switch on time differences, unequal delays, and/or the unequal or changing currents among the switchable current sources. To reduce the effect of transients in current scaling DACs it is known to provide a decoding scheme to reduce the effect of severe transitions resulting from certain binary inputs. For example, in an eight bit DAC having no decoding scheme, the transition from 127 (binary 01111111) to 128 (binary 10000000) would result in the shutting off of seven smaller current sources as the largest one is turned on. With a decoding scheme these effects are reduced by spreading such transitions over the range of the binary inputs. Complex decoding schemes can be arrived at that provide smoother transitions, but such arrangements require more die area to accommodate the decoding circuitry. Such a decoding circuit is set forth in U.S. Pat. No. 4,904,922 issued to Joseph H. Colles on Feb. 27, 1990.

The switching action of a given individual switchable current source can also contribute to, or generate by itself, output transients. Output transients are particularly bothersome to video DACs because they can result in distracting anomalies on the video display screen.

Other prior art methods to reduce output transients have focused on minimizing the switching delays between the weighted current sources. However, in extremely fast DACs, there is a finite limit to this type of approach due to integrated circuit size and the fabrication process employed. Other attempts to reduce output transients have included sample-and-hold circuits that sample the DAC output after any potential transients have passed. In many cases such solutions are impractical due to the amount of space required for such circuits and/or the conversion speed required for a given application.

Accordingly, it would be desirable to have a fast DAC switchable current source that reduces output transients and does not require a large amount of additional devices, or a complex fabrication process. To the inventor's knowledge, no prior art switchable current source has been provided that meets these needs.

SUMMARY OF THE INVENTION

Accordingly, it is an object of the present invention to provide a switchable current source that reduces switch-on transients.

It is another object of the present invention to provide a switchable current source with a current magnitude controlling circuit that is isolated from the current switch.

It is still another object of the present invention to provide a switchable current source that reduces the amount of decoding circuitry required for a digital-to-analog converter.

Briefly, the preferred embodiment of the present invention is a switchable current source for providing a weighted output current to an output node in response to an enable signal. The present invention includes a current source and a current switch. The current source provides an output current in response to a reference current, and is formed by a current mirror connected in a cascode arrangement to a cascode pair of transistors. Both the current mirror and the cascode pair are formed by two p-channel transistors. The current mirror is coupled to the supply voltage and the cascode pair is coupled to the current mirror. The cascode pair provides an input reference current node and an output current node. A reference current is provided to the input reference current node by a reference current source. A current switch is connected to the output current node and provides alternate switch paths; a first current path to ground and a second current path to the output node. The switchable current source switches between and "on" state and an "off" state in response to an enable signal provided by an enable signal source.

In the off state, the current switch provides the first current path to ground. In the on state the first current path is disabled and the second current path to the output node is provided. The current switch and enable signal are designed so that in an off-to-on transition the second current path is provided prior to disabling the first current path. In a similar fashion, in an on-to-off transition the first current path is provided prior to disabling the second current path. This "make-before-break" operation of the current switch has been found to greatly reduce output transients in DACs employing the present invention.

An advantage of the present invention is that it can be realized with current source transistors having a smaller channel length than that of the prior art.

Further objects and advantages of the present invention will become clear to those skilled in the art in view of the description of the best presently known modes of carrying out the invention, and the industrial applicability of the preferred embodiments as described herein and as illustrated in the several figures of the drawings.

DETAILED DESCRIPTION OF THE PREFERRED EMBODIMENT

Figure 1:
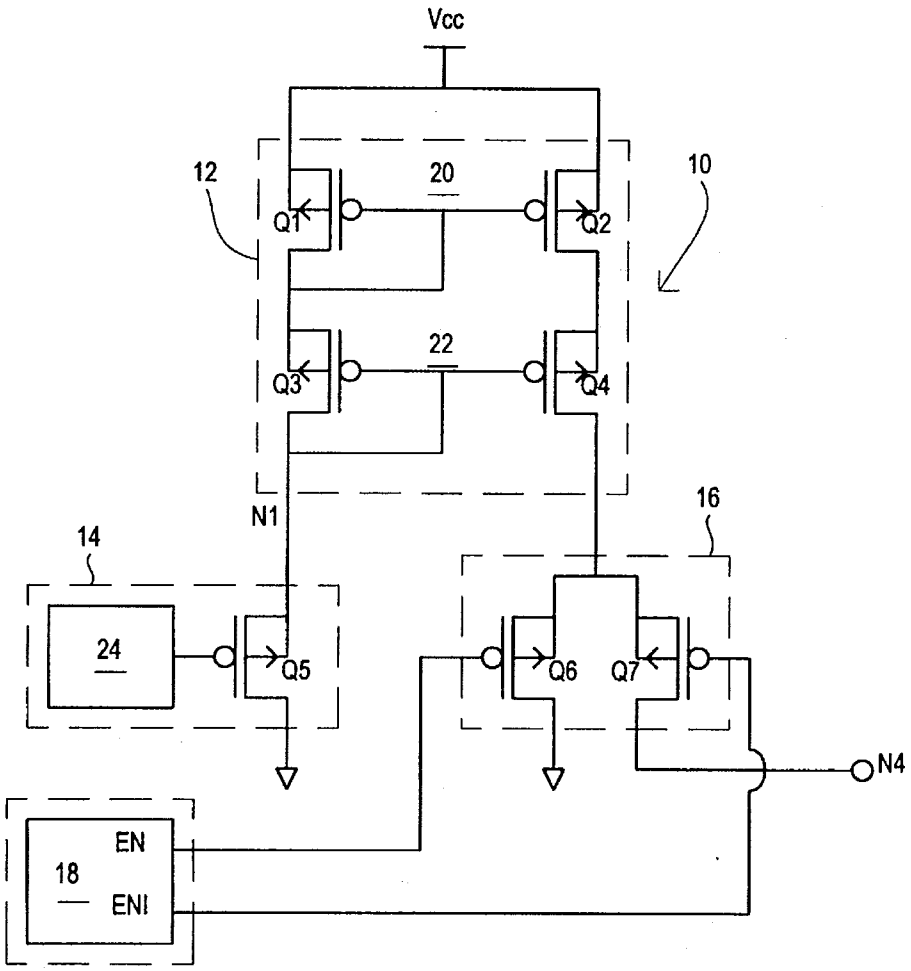
FIG. 1 is a block schematic diagram illustrating the preferred embodiment of the present invention.

The preferred embodiment of the present invention is a switchable current source and is set forth in detail in FIG. 1, and designated by the general reference character 10. The switchable current source can be conceptualized as being composed of a current source 12, a reference current generator 14, a current switch 16 and an enable signal generator 18.

The current source 12 of the preferred embodiment 10 includes a current mirror 20 and a cascode pair 22. The current mirror 20 includes a first PMOS transistor Q1 and a second PMOS transistor Q2. Both Q1 and Q2 are connected by their respective sources to the positive supply voltage Vcc. In addition, Q1 and Q2 are gate coupled, with Q1 having its gate further connected to its drain. The cascode pair 22 is similar to the current mirror 20 being composed of two gate-coupled PMOS transistors Q3 and Q4, the gate of Q3 being further connected to its drain. The cascode pair 22 is coupled to the current mirror 20 by connecting the drains of Q1 and Q2 to the sources of Q3 and Q4, respectively. The current source 12 provides an output current in response to a reference current. In the preferred embodiment 10, the reference current is supplied at node N1, and an output current is generated at node N2. The transistor pairs making up the current mirror and cascode pair (20 and 22) of the preferred embodiment 10 are scaled. That is, the channel width-to-length ratio (W/L) of Q2 and Q4 are three times than that of Q1 and Q3. This allows for a more compact design, enabling the smaller transistors to control the larger ones. While the preferred embodiment employs a 1:3 ratio, it is understood that other ratios may be selected.

The present inventor has found that combination of current mirror 20 with cascode pair 22 provides a stable voltage level at node N3. As current is drawn through the current source 12, any source-drain voltage drop occurs between node N2 and node N3, with the source-drain voltage between N3 and Vcc remaining relatively constant. This reduces current variations and transients in the current source 12 and allows Q2 to be designed with a smaller channel length than prior art designs. This reduces the overall layout size of the circuit. In addition, because transistors Q1, Q3 and Q5 are isolated from any switching functions, switching does not adversely affect bias conditions of the current mirror 20 and consequently, the current supplied remains stable during all phases of operation.

The reference current generator 14 of the preferred embodiment 10 includes a voltage generator 24 and a PMOS transistor Q5. Referring once again to FIG. 1, it is shown that Q5 is connected by its source to node N1, by its gate to the voltage generator 24, and by its drain to ground. A reference current is supplied at N1 according to the biasing voltage applied to the gate of Q5 by the voltage generator 24. One skilled in the art would recognize that the type and arrangement of the voltage generator 24 is not critical to the invention and so will not be set forth in detail herein. All that is necessary is for the appropriate voltage to be applied to generate the desired reference current. It is noted that in the preferred embodiment 10, the reference current generated is one third of the desired output current, due to the W/L ratios of the transistors in the current source 20 and the cascode pair 22. Accordingly, once the desired gate voltage is applied to Q5 an output current will be present at node N2.

In the preferred embodiment 10, the current switch 16 includes two PMOS transistors Q6 and Q7. Q6 and Q7 are connected by their respective sources to node N2. The drain of Q6 is connected to ground, and the drain of Q7 is connected to an output node N4. The gates of both Q6 and Q7 are connected to the enable signal generator 18, with Q6 receiving an enable signal "EN", and Q7 receiving an inverted enable signal "ENI".

Figure 2:
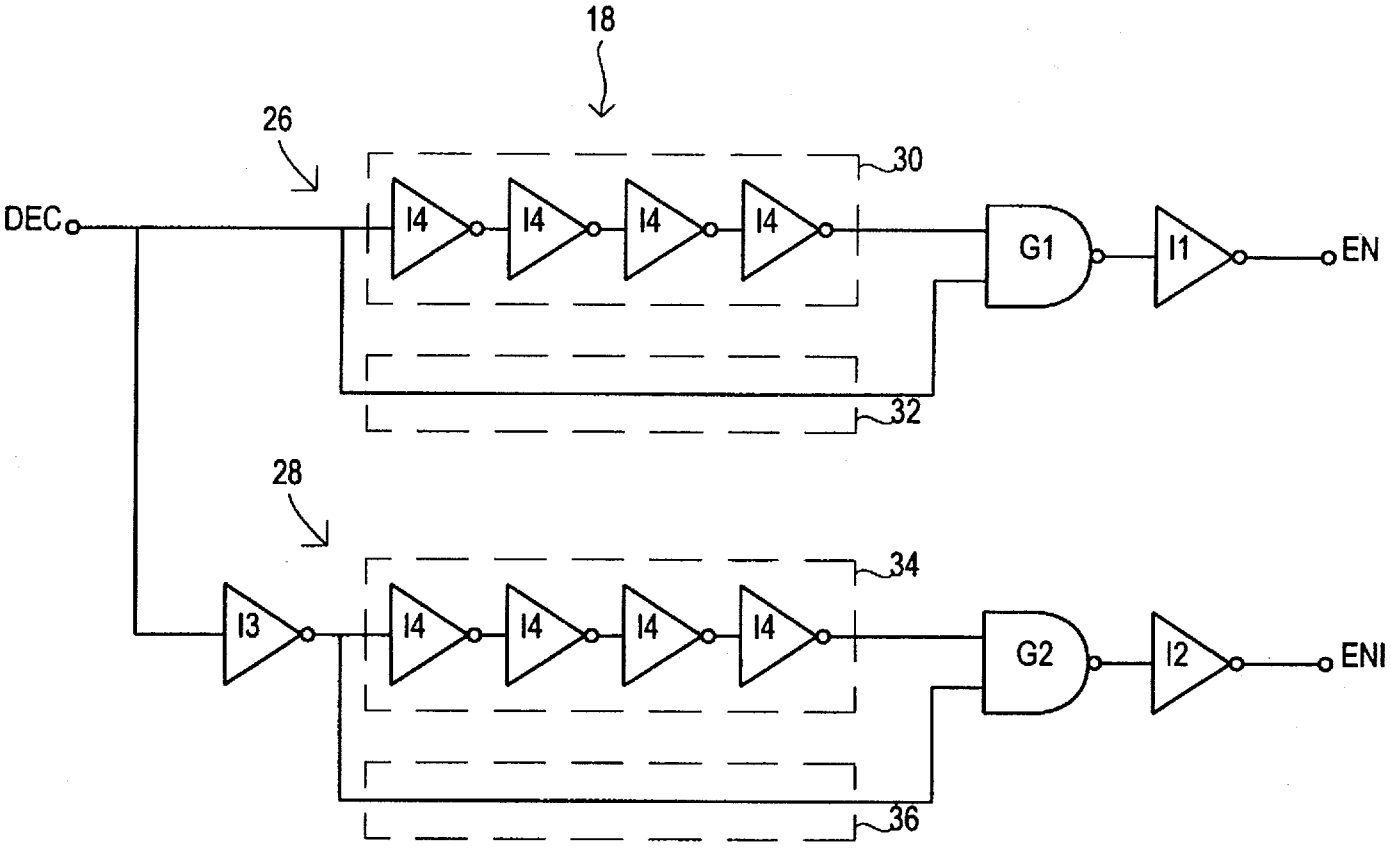
FIG. 2 is a block schematic diagram illustrating the enable signal generator of the preferred embodiment of the present invention.

The enable signal generator 18 is set forth in detail in FIG. 2. As illustrated in the figure the enable signal generator 18 receives a decoder input "DEC" and provides the EN and ENI output signals. The enable signal generator is shown to include a first branch 26 and a second branch 28. The first branch 26 receives the DEC signal and then splits down a first delay path 30 and a first direct path 32. The two paths (30 and 32) terminate as mutual inputs to a NAND gate G1. G1 provides an output to inverter I1, which in turn, provides the EN signal. The second branch 28 is similar to the first branch, having a second delay path 34, a second direct path 36, a NAND gate G2 and an inverter I2 arranged in a similar fashion. The second branch 28 differs from the first in that the DEC signal first passes through an inverter I3, prior to entering the second delay path 34 and second direct path 36. As shown in FIG. 2, the delay paths (30 and 34) are formed by four successive delay inverters, each identified as I4. The inverters I4 function to delay the propagation of the DEC signal down their respective paths.

Referring once again to FIG. 2, when the DEC signal is low, EN is low and ENI high. Conversely, when DEC goes high, EN also goes high, with ENI going low. It is during the transitions between these two states that the delay paths (30 and 34) serve an important function.

Figure 3:
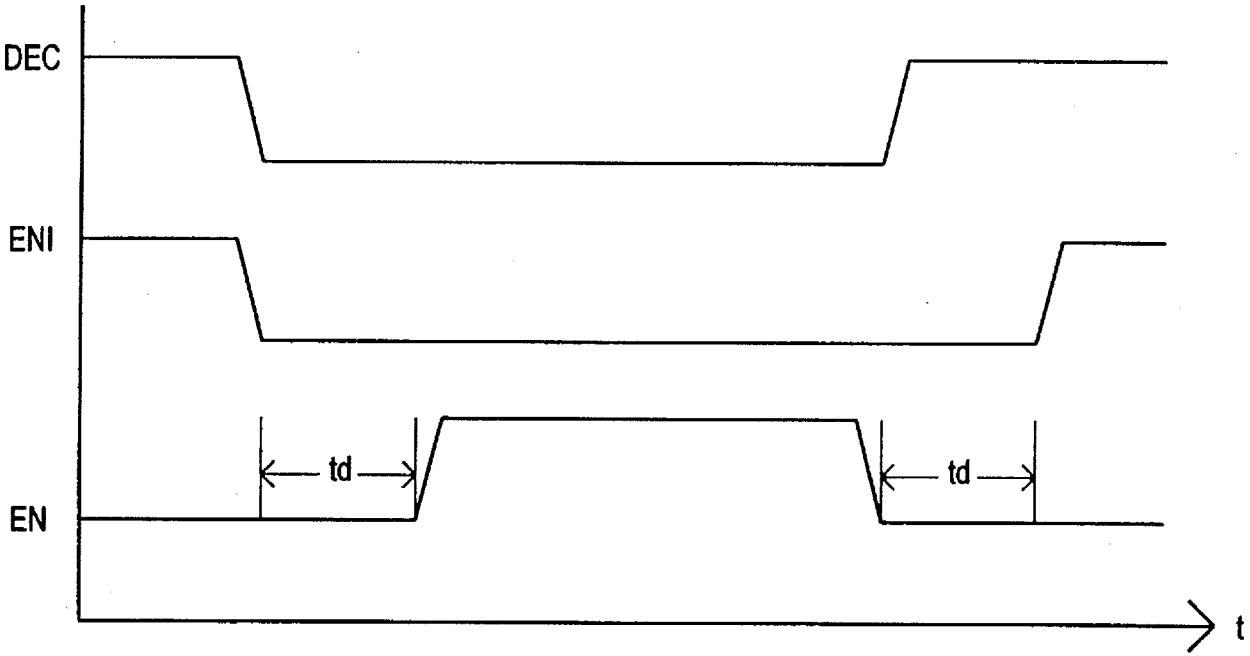
FIG. 3 is a timing diagram illustrating the operation of the enable signal generator.

The function of the delay paths is best understood by referring to the timing diagram of FIG. 3 in conjunction with FIG. 2. As illustrated in the figure, as DEC goes from high to low, EN follows by going low, due to logic created by the propagation of DEC down the first direct path and the resulting logic at the input of G1. In contrast, in order for the logic state to change at ENI, G2 must receive the DEC signal from both the second direct path and the second delay path. This creates a slight delay shown as "td" (less than a nanosecond in the preferred embodiment) between the change of state between EN and ENI in the high-to-low transition of DEC. One skilled in the art would recognize that the enable signal generator 18 of the preferred embodiment 10 provides a similar function for the opposite change of state. As is illustrated in FIG. 3, in a low-to-high transition of DEC, ENI will go low before EN goes high, with EN having the td delay.

Referring once again to FIG. 1, it is shown that EN is coupled to the gate of Q6 and ENI to the gate of Q7. From the timing of EN and ENI illustrated in FIG. 3, it is shown that EN and ENI drive transistors Q6 and Q7 in a "make-before-break" switching arrangement between ground and the output node N4. When the DEC signal is high, Q7 is on and Q6 is off, and the output current from the current source 12 flows to the output node N4. As DEC undergoes a high-to-low transition, Q6 is more quickly turned on, briefly creating two current paths through both Q6 and Q7. Following the short time delay, td, Q7 is shut off by the EN signal going high. When the DEC signal is settled in a low state Q6 is on and Q7 is off, and the output current flows to ground. In a low-to-high transition of signal DEC, Q7 is more quickly turned on, creating simultaneous current paths to ground and the output node N4 through Q6 and Q7, respectively. After the delay td, Q6 is shut off and only Q7 remains on. This switching order provided by the enable signal generator 18 creates a "make-before-break" switch, ensuring the connection is made to one current path prior to disconnecting from the other current path. In this manner, the output current provided by the current source 12 is constant, being rerouted to ground, the output node N4, or both, in the short time period that occurs during the switching between Q6 and Q7.

It is noted that the inventor has found the "make before break" switching arrangement greatly reduces any transients generated by switching the current source 12 to the output node. Absent such switch timing the current source 12 can be briefly interrupted, and voltage transients can develop at node N4, despite the advantages of the current mirror 20/cascode pair 22 design. As a result, time would be required to reestablish stable behavior in the current source 12. While the preferred embodiment sets forth a "make before break" switching arrangement with a particular current source 12, it is understood the same switching arrangement may be applied to other current sources to reduce output transients.

While the preferred embodiment is composed of PMOS devices, one skilled in the art would recognize the present invention can be realized in other embodiments, including NMOS devices and equivalent bipolar analogs.

As will be apparent to one skilled in the art, the invention has been described in connection with its preferred embodiments, and may be changed, and other embodiments derived, without departing from the spirit and scope of the invention.

INDUSTRIAL APPLICABILITY

The switchable current source of the present invention 10 is primarily intended for use in video digital-to-analog converters (DACs). However, the present invention 10 may be utilized in any application wherein conventional DACs are used. The main area of improvement is the reduction in the magnitude of transients produced when the output current of the weighted current sources are switched to a common current summing node.

Since the switchable current source of the present invention may be readily constructed using present fabrication methods, it is expected that they will be acceptable in the industry as substitutes for conventional DAC current sources. For these and other reasons, it is expected that the utility and industrial applicability of the invention will be both significant in scope and long-lasting in duration.

What I claim is:

1. A switchable current source comprising:

a current source having a reference input and a current output;

reference current means coupled to the reference input for supplying a reference current to said current source;

signal generating means for generating an enable signal; and current switch means coupled to the current output for switching the current output path between an output node and a ground node, said current switch means responsive to the enable signal such that a first current path is provided between the current output and the output node prior to disabling a second current path between the current output and the ground node.

2. The switchable current source of claim 1 wherein:

said signal generating means generates a disable signal; and said current switch means is responsive to the disable signal such that the second current path is provided between the current output and the ground node prior to disabling the first current path between the current output and the output node.

3. The switchable current source of claim 1 wherein:

said current source includes a current mirror having a first MOS reference transistor and a first MOS source transistor, the current mirror being coupled to a cascode pair of MOS transistors, the cascode pair having a second MOS reference transistor and a second MOS source transistor.

4. The switchable current source of claim 3 wherein:

said current source is comprised of PMOS transistors.

5. The switchable current source of claim 1 wherein:

said reference current means is a biased MOS reference transistor.

6. The switchable current source of claim 5 wherein:

the MOS reference transistor is a PMOS transistor connected by its source to the reference input of said current source, by its drain to a ground node, and by its gate to a reference bias voltage.

7. The switchable current source of claim 1 wherein:

said current switch means includes at least one MOS current switch.

8. The switchable current source of claim 7 wherein:

said signal generating means is responsive to a decode input signal, and the enable signal includes a switch signal and a complementary switch signal; and said current switch means includes a first MOS switch transistor coupled between the current output and the ground node, and a second MOS switch transistor coupled between the current output and the output node, the gate of the first MOS switch transistor receiving the switch signal, and the gate of the second MOS switch transistor receiving the complementary switch signal.

9. The switchable current source of claim 8 wherein:

said signal generating means further includes a first delay means responsive to a first logic transition in the decode input signal for delaying the enable signal; and a second delay means responsive to a second logic transition in the decode input for delaying the complementary enable signal.

10. The switchable current source of claim 8 wherein:

the first MOS switch transistor is a PMOS transistor and the second MOS switch transistor is a PMOS transistor.

11. In a current scaling digital-to-analog converter, a current source and switching circuit for providing an output current, comprising:

at least one current source having a first transistor and a second transistor, the first transistor being gate coupled to both its drain and to the gate of the second transistor, said current source providing a current input transistor and a current output transistor;

bias means coupled to the drain of the current input transistor for providing a reference current;

enable signal means responsive to an enable input for generating a first enable signal and a second enable signal, said enable signal means including a first delay means for delaying the first enable signal;

a first current switch coupled to the drain of the current output transistor, said first current switch responsive to the first enable signal; and a second current switch coupled to the drain of the current output transistor, said second current switch responsive to the second enable signal.

12. The current source and switching circuit of claim 11 wherein:

the transistors of said plurality of current sources are p-channel MOS devices.

13. The current source and switching circuit of claim 12 wherein:

said current source further includes a third transistor and a fourth transistor, the third transistor being coupled by its source to the drain of the first transistor, the fourth transistor being coupled by its source to the drain of the second transistor, the third transistor being the current input transistor, the fourth transistor being the current output transistor.

14. The current source and switching circuit of claim 12 wherein:

said bias means includes a bias voltage source for providing a bias voltage; and a p-channel MOS device having its source coupled to the drain of the current input transistor and its gate coupled the bias voltage source.

15. The current source and switching circuit of claim 12 wherein:

said first current switch is a p-channel MOS device having its gate coupled to the first enable signal, its drain coupled to the source of the current output transistor, and its source coupled to ground.

16. The current source and switching circuit of claim 12 wherein:

said second current switch is a p-channel MOS device having its gate coupled to the second enable signal, its drain coupled to the source of the current output transistor, and its source coupled to an output node.

17. The current source and switching circuit of claim 11 wherein:

the enable input to said enable means changes between at least a first logic transition and a second logic transition; and said enable signal means further includes a first signal branch including the first delay means, the first delay means responsive to the first logic transition for delaying the first enable signal, and a second signal branch including a second delay means, the second delay means responsive the second logic transition for delaying the second enable signal.

18. The current source and switching circuit of claim 17 wherein:

the first signal branch includes a first delay path, a first direct path, and a first logic gate, the first delay path and the first direct path receiving the enable input and providing inputs to the first logic gate; and the second signal branch includes an input inverter, a second direct path, a second delay path and a second logic gate, the input inverter receiving the enable input and providing an output to the second direct path and the second delay path which provide inputs to the second logic gate.

19. The current source of claim 18 wherein:

the first delay path and second delay path of the enable signal means each include a plurality of delay inverters.

20. The current source of claim 18 wherein:

the first logic gate and the second logic gate of the enable signal means each include a NAND gate and an output inverter, each NAND gate receiving the inputs from its respective delay and direct paths and providing an input to its respective output inverter, the output inverters providing the first enable signal and the second enable signal.

* * * * *